US007748230B2

(12) United States Patent
An

(10) Patent No.: US 7,748,230 B2
(45) Date of Patent: Jul. 6, 2010

(54) REFRIGERATOR WITH ICE MAKING DEVICE

(75) Inventor: Jae-Koog An, Gwangju (KR)

(73) Assignee: Samsung Electronics Co., Ltd., Suwon si (KR)

( * ) Notice: Subject to any disclaimer, the term of this patent is extended or adjusted under 35 U.S.C. 154(b) by 331 days.

(21) Appl. No.: 11/654,661

(22) Filed: Jan. 18, 2007

(65) Prior Publication Data

US 2007/0163285 A1 Jul. 19, 2007

(30) Foreign Application Priority Data

Jan. 19, 2006 (KR) ..... 10-2006-0006004

(51) Int. Cl.
*F25C 5/02* (2006.01)

(52) U.S. Cl. ..... 62/320; 241/DIG. 17

(58) Field of Classification Search ..... 62/320, 62/344; 241/DIG. 17
See application file for complete search history.

(56) References Cited

U.S. PATENT DOCUMENTS 3,824,805 A * 7/1974 Prada ..... 62/320
4,176,527 A * 12/1979 Linstromberg et al. ..... 62/320
5,056,688 A * 10/1991 Goetz et al. ..... 222/146.6
7,111,473 B2 * 9/2006 Chung et al. ..... 62/320
7,278,275 B2 * 10/2007 Voglewede et al. ..... 62/320
2004/0261442 A1 12/2004 Chung et al.

FOREIGN PATENT DOCUMENTS

CN 1517646 A 8/2004
JP 10-318638 12/1998

OTHER PUBLICATIONS

Chinese Office Action for corresponding Chinese Application 200710002030.6; issued Aug. 8, 2008.

* cited by examiner

*Primary Examiner*—William E Tapolcai
(74) *Attorney, Agent, or Firm*—Staas & Halsey LLP

(57) ABSTRACT

A refrigerator includes an ice container storing the ice made in an ice making device and including an opening through which the ice is discharged and a carrying shaft carrying the stored ice to the opening; an outlet, into which ice carried through the opening is supplied, discharging the ice to an outside of the refrigerator; and a three rotating blades coupled with the carrying shaft and carrying the ice discharged from the opening to the outlet, wherein the outlet is arranged to deviate from an ice discharging axis of the opening.

13 Claims, 6 Drawing Sheets

REFRIGERATOR WITH ICE MAKING DEVICE

CROSS-REFERENCE TO RELATED APPLICATIONS

This application claims priority from Korean Patent Application No. 10-2006-0006004, filed on Jan. 19, 2006, in the Korean Intellectual Property Office, the disclosure of which is incorporated herein by reference.

BACKGROUND OF THE INVENTION

1. Field of the Invention

The present invention relates to a refrigerator, and more particularly, to a refrigerator having an improved configuration for ice discharging.

2. Description of the Related Art

In general, a refrigerator is provided with a refrigerating chamber and a freezing chamber to keep various kinds of food for a period of time. The refrigerating chamber stores food, such as fruits and vegetables, that are kept above a freezing temperature. The freezing chamber stores food, such as fish and meat, that is kept below a freezing temperature.

The freezing chamber may be provided with an ice making device which uses cold air circulating in the freezing chamber to make ice cubes of a predetermined size, and an ice storage part storing the ice made in the ice making device. The ice stored in the ice storage part is cut into ice cubes or crushed ice according to an intended use to be discharged to the outside.

A conventional refrigerator in FIGS. 4*a* and 4*b*, for example, includes an ice storage part 121 having an opening 125 through which ice is discharged, a cover 135 having an outlet 137 through which the ice from the opening 125 is discharged to the outside, a supporting blade 145, a pair of rotating blades 141 shaving ice moving with respect to the supporting blade 145, and an operating lever 151 reciprocally moving between a shaving position which approaches the supporting blade 145 and shaves ice and an opening position such that the operating lever 151 is separated from the supporting blade 145 and does not shave ice.

The pair of rotating blades 141 are arranged making an isometric angle of 180°. Also, the opening 125 and the outlet 137 are arranged vertically on a side of the ice storage part 121.

In the case that a user discharges the ice stored in the ice storage part 121 without shaving, as shown in FIG. 4*a*, the operating lever 151 is separated from the supporting blade 145, and the ice discharged from the opening part 125 of the ice storage part 121 directly falls down toward the outlet 137 and then is discharged from the outlet part 137 to the outside.

In the case that a user selects crushed ice, as shown in FIG. 4*b*, the operating lever 151 approaches the supporting blade 145 and the ice discharged from the opening 125 is not directly discharged to the outlet 137, but carried to the supporting blade 145 by the rotating blades 141 to be crushed by the supporting blade 145 and the rotating blades 141. Then ice is discharged as crushed ice through the outlet 137 to the outside.

However, in the conventional refrigerator, the opening 125 and the outlet 137 are typically vertically arranged. Specifically, the outlet 137 is provided in a direct lower part of the opening 125, and when the ice stored in the ice storage part 121 is discharged without being crushed, the ice discharged from the opening 125 falls straight down to the outlet 137 to be discharged. As the amount of the ice cubes discharged from the ice storage part 121 varies according to the storage capacity of the ice storage part 121, if the ice is discharged excessively, the amount of ice from the outlet 137 cannot be controlled, and the ice may overflow from the storage container into which the ice is discharged, thereby causing inconvenience for a user. Also, when the ice is shaved prior to being discharged, as the amount of ice discharged from the opening 125 is not consistent, the load on the respective blades 141 and 145 increases and the ice sputters due to the excessive amount of ice used when the ice is shaved.

SUMMARY OF THE INVENTION

It is therefore an aspect of the invention to provide a refrigerator which is capable of discharging ice in a consistent amount to improve convenience for a user and of reducing the load of blades when shaving ice, thus preventing damage of parts caused by overloading of the blades.

Additional aspects and/or advantages of the invention will be set forth in part in the description which follows and, in part, will be apparent from the description, or may be learned by practice of the invention.

The foregoing and/or other aspects of the present invention are achieved by providing a refrigerator, including: an ice making device making ice; an ice container storing the ice made in the ice making device and including an opening through which the ice is discharged and a carrying shaft carrying the stored ice to the opening; an outlet, into which ice carried through the opening is supplied, discharging the ice to an outside of the refrigerator; and three rotating blades coupled with the carrying shaft and carrying the ice discharged from the opening to the outlet, wherein the outlet is arranged to deviate from an ice discharging axis of the opening.

According to the embodiment of the present invention, the refrigerator further includes a cover in which an ice carrying path is formed to carry the ice discharged from the opening to the outlet.

According to the embodiment of the present invention, the refrigerator further includes a supporting blade provided adjacent to the outlet and reciprocally moving with respect to the rotating blades.

According to the embodiment of the present invention, the refrigerator further includes an operating lever reciprocally moving between a first position in which the operating lever approaches the supporting blade and shaves the ice and a second position in which the operating lever is separated from the supporting blade and does not shave ice, wherein the operating lever is arranged adjacent to the opening.

According to the embodiment of the present invention, the refrigerator includes a lever operating part driving the operating lever so that the operating lever can reciprocally move between the first position and the second position.

According to the embodiment of the present invention, the rotating blades are arranged in a substantially isometric angle.

The foregoing and/or other aspects of the present invention are also achieved by providing a refrigerator, including: an ice container having an opening to discharge ice; a cover having an outlet discharging the ice, into which ice carried through the opening is supplied, to an outside of the refrigerator and an ice carrying path formed to carry the ice discharged from the opening to the outlet; a plurality of rotating blades to carry the ice discharged from the opening to the outlet through the ice carrying path; a supporting blade arranged adjacent to the outlet and supported to shave the ice; and an operating lever reciprocally moving between a first position in which ice cubes are discharged and a second position in which shaved ice is discharged; and a lever operating part driving the operating lever so that the operating lever can reciprocally move between the first position and the second position.

According to the embodiment of the present invention, the rotating blades are arranged in a substantially isometric angle.

According to the embodiment of the present invention, the rotating blades include at least four blades.

According to the embodiment of the present invention, the operating lever is rotatably connected with the ice storage part.

According to the embodiment of the present invention, the outlet is arranged opposite the opening of the ice container with respect to the carrying shaft so that the ice discharged from the opening can be carried by the rotating blades and be discharged through the outlet to the outside.

The foregoing and/or other aspects of the present invention are also achieved by providing a refrigerator, comprising: an ice container having an opening to discharge ice and a carrying shaft to carry the ice to the opening; a cover having an outlet discharging the ice, into which the ice discharged from the opening is supplied, to an outside of the refrigerator and an ice carrying path formed to carry the ice discharged from the opening to the outlet; a plurality of rotating blades coupled to the carrying shaft; and a supporting blade placed between the outlet and the opening and shaving the ice along with the rotating blades, wherein the outlet is arranged to deviate from an ice discharging axis of the opening, and the shaved ice and the ice cubes are discharged in one direction with respect to the supporting blade.

According to the embodiment of the present invention, the rotating blades are arranged in a substantially isometric angle.

According to the embodiment of the present invention, the rotating blades include at least four blades.

According to the embodiment of the present invention, the refrigerator further includes an operating lever reciprocally moving between a shaving position which approaches the supporting blade and shaves the ice and an opening position which is separated from the supporting blade and does not shave the ice.

The foregoing and/or other aspects of the present invention are also achieved by providing an ice supplying device including an ice container storing ice; an outlet, into which ice is supplied, receiving ice from the ice container; and an ice carrying part carrying ice from an internal portion of the ice container to the outlet, the ice carrying part moving ice in a forward direction to an opening of the ice container and into the outlet.

According to the embodiment of the present invention, the ice supplying device includes a plurality of rotating blades coupled with the carrying shaft and carrying the ice discharged from the opening to the outlet.

The foregoing and/or other aspects of the present invention are also achieved by providing a refrigerator including a refrigerating chamber cooling material in the refrigerating chamber above a freezing temperature; a freezing chamber cooling material in the freezing chamber at or below the freezing temperature; an ice container disposed within the freezing chamber and storing ice made in the freezing chamber; an outlet, into which ice is supplied, receiving ice from the ice container; and an ice carrying part carrying ice from an internal portion of the ice container to the outlet, the ice carrying part moving ice in a forward direction to an opening of the ice container and into the outlet.

Additional aspects of the present general inventive concept will be set forth in part in the description which follows and, in part, will be apparent from the description, or may be learned by practice of the general inventive concept.

BRIEF DESCRIPTION OF THE DRAWINGS

The above and/or other aspects and advantages of the prevent invention will become apparent and more readily appreciated from the following description of the embodiments, taken in conjunction with the accompanying drawings, in which.

DETAILED DESCRIPTION OF THE PREFERRED EMBODIMENTS

Figure 1:
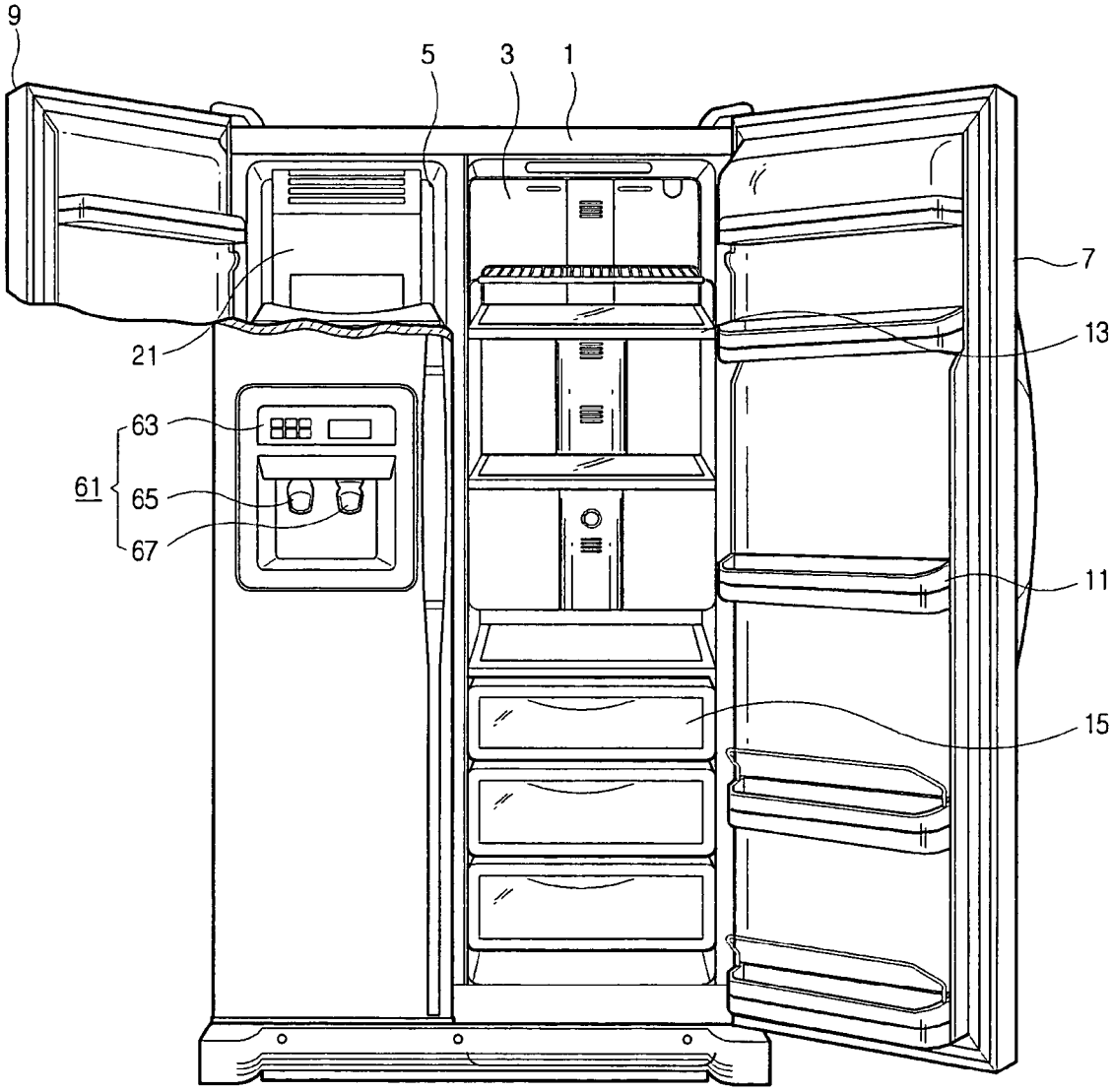
FIG. 1 is a front view showing a refrigerator according to an embodiment of the present invention.

Reference will now be made in detail to the embodiment of the present invention, an example of which is illustrated in the accompanying drawings, wherein like reference numerals refer to like elements throughout. The embodiment is described below so as to explain the present invention by referring to the figures.

In explaining an embodiment of the present invention, a side-by-side type of refrigerator is taken as an example, but the present invention is not limited thereto.

Figure 2:
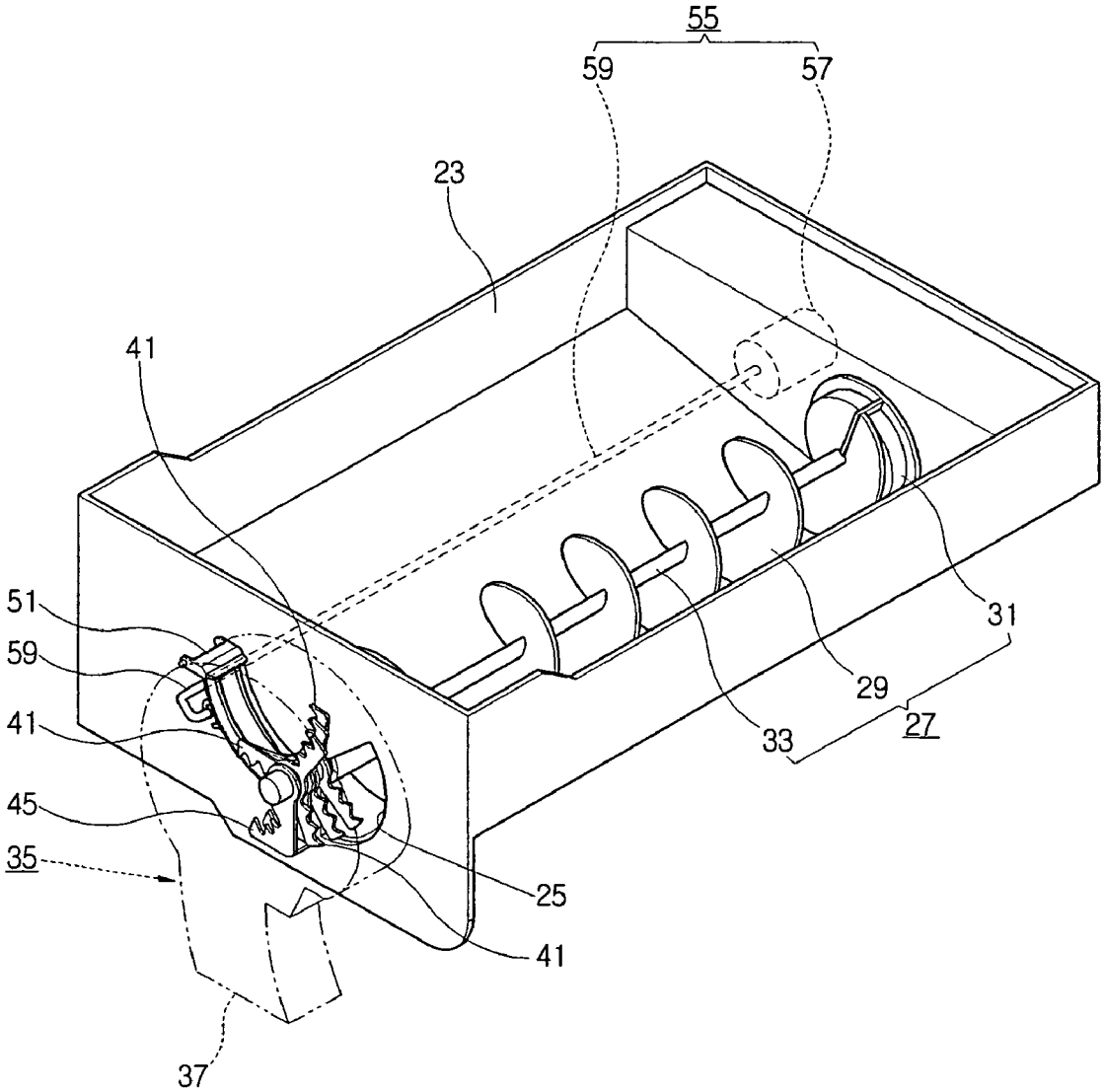
FIG. 2 is a schematic view illustrating a main part of an ice storage part of FIG. 1.

As shown in FIGS. 1 and 2, a refrigerator according to an embodiment of the present invention includes a freezing chamber 5, a freezing chamber door 9, an ice storage part 21 provided in the freezing chamber 5, and a dispenser part 61 through which ice in the ice storage part 21 can be dispensed.

The refrigerator according to the embodiment of the present invention is further provided with a refrigerating chamber 3 and the refrigerating chamber 3 and the freezing chamber 5 are formed by a partitioning wall in a main body 1 of the refrigerator. A refrigerating chamber door 7 and the freezing chamber door 9 are provided in front openings of the refrigerating chamber 3 and the freezing chamber 5 in order to open and close the front opening thereof. A plurality of door guides 11 are arranged in an internal side of the refrigerating chamber and freezing chamber doors 7 and 9 to contain bottles, for example. Furthermore, a plurality of shelves 13 comparting the internal side of the refrigerating chamber 3 may be arranged in an upper part of the refrigerating chamber 3 and a plurality of drawers 15 may be arranged in a lower part thereof.

The ice storage part 21 provided in an upper part of the freezing chamber 5 stores ice made in an ice making chamber (not shown), which is supplied with water from an external water supplier to make ice.

The ice storage part 21 in FIG. 2 includes an ice container 23 having an opening 25 and an ice carrying part 27 to carry the ice contained in the ice container 23 to the opening 25. An internal portion is defined within the ice container 23 to hold the ice.

The ice carrying part 27 includes a rotating body 29 carrying the ice stored in the ice container 23 to the opening 25, an ice carrying motor 31 operating the rotating body 29, and a carrying shaft 33 connecting the rotating body 29 with the ice carrying motor 31.

A cover 35, which connects with an ice duct 71 (to be described later), is mounted onto a side of the ice container 23 in which the opening 25 is formed. The cover 35 is formed with an outlet 37 through which ice is discharged to the outside. An ice carrying path 39 (refer to FIG. 3*b*) is formed in the cover 35, through which ice cubes from the opening 25 are carried by rotating blades 41 to the outlet 37, such that ice cubes are moved forward toward the opening 25 of the ice container 23. A guide 35*a* having a semicircular shape is provided in an area of an internal plate of the cover 35 and is partially projected along a perimeter of a rotational radius of the rotating blades 41 to carry ice cubes from the opening 25 to the outlet 37. The outlet 37 of the cover 35 is disposed on an opposite side of the opening 25 of the ice container 23 with respect to the carrying shaft 33. In other words, the outlet 37 of the cover 35 is arranged to deviate from an ice discharging axis of the opening 25 of the ice container 23. Accordingly, the ice from the opening 25 is not discharged directly to the outlet 37, but is carried to the outlet 37 along the back of the rotating blades 41. Thus, the amount of ice cubes carried through the rotating blades 41 to the outlet 37 is limited to be suitable for the space among the rotating blades 41. Accordingly, even though an excessive amount of ice cubes may be discharged from the opening 25, the amount of the ice received out of the outlet 37 can be prevented from being excessively discharged. Also, when ice is shaved, overload of the rotating blades 41 and supporting blades 45 can be prevented.

Three rotating blades 41, a supporting blade 45 and an operating lever 51 are provided between the ice container 23 and the cover 35. The rotating blades 41 carry the ice discharged from the opening 25 to the outlet 37. Further, the supporting blade 45 is provided adjacent to the outlet 37 and moves relatively with respect to the rotating blades 41. The operating lever 51 reciprocally moves between a shaving position, in which the operating lever 51 approaches the supporting blade 45 and shaves ice, and an opening position, in which the operating lever 51 is separated from the supporting blade 45 and does not shave ice. The operating lever 51 is provided opposite the opening 25 and in an upper part of the outlet 37.

The respective rotating blades 41 in the present embodiment are arranged to make an isometric angle of 120°. Accordingly, the ice cubes discharged from the opening 25 are not discharged over an amount of ice contained in the 120° angle in which the rotating blades 41 are arranged. When the rotating blades 41 rotate, the ice is therefore discharged regularly. The respective blades 41 are coupled to the carrying shaft 33 to rotate in connection with the rotating body 29. A plurality of sharp projections to shave ice is formed in front of the respective rotating blades 41. Accordingly, a predetermined amount of ice corresponding to the rotating speed of the rotating blades 41 can be carried to the outlet 37 by the rotating blades 41, thereby preventing overloading of the rotating blades 41.

The supporting blade 45 is arranged partially across the outlet 37 and is provided within a rotating radius of the rotating blades 41, misalignedly with the rotating blades 41, to shave the ice carried by the rotating blades 41 into crushed ice.

The operating lever 51, which is rotatably coupled to one side of the ice container 23, approaches or is separated from the supporting blade 45. The operating lever 51 reciprocally moves between the shaving position and the opening position by a lever operating part 55. As described above, the operating lever 51 may be arranged on an opposite side of the opening 25 with respect to the carrying shaft 33. That is, the operating lever 51 is adjacent to the outlet 37. The outlet 37 is provided at a lower part of the operating lever 51 and provides for the discharge of the ice cubes or crushed ice that is carried through the rotating blades 41 to the outside of the refrigerator by operating the operating lever 51.

The lever operating part 55 in the present embodiment includes a driving motor 57 and a link 59 connecting the driving motor 57 with the operating lever 51 and carrying driving power of the driving motor 57 to the operating lever 51. The operating lever 51 may be driven by, for example, a solenoid valve.

A dispenser part 61 receiving ice from the ice storage part 21 and an ice duct 71 guiding the ice discharged from the ice storage part 21 to the dispenser part 61 are provided in the freezing chamber door 9.

The dispenser part 61 may include an operating panel 63 allowing a user to select a kind of ice and input a control command, an ice lever 65 to discharge the ice, and a water lever 67 to supply water. An ice selecting switch (not shown) is provided in the operating panel 63 to allow a user to input a command to make ice cubes and/or crushed ice.

By this configuration, an ice discharging process of the refrigerator according to the embodiment of the present invention will be described as follows.

Figure 3A:
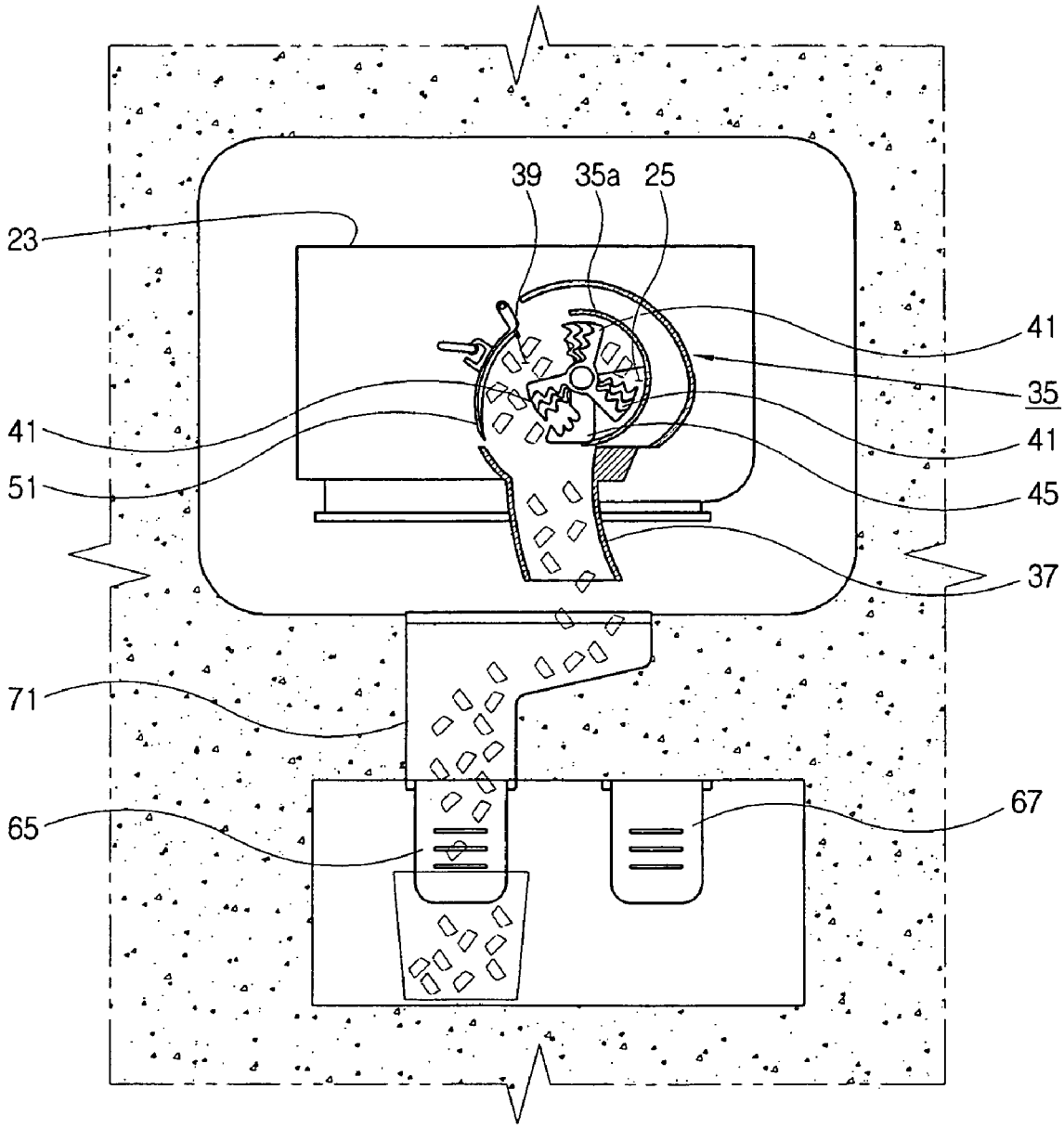
FIGS. 3*a* and 3*b* illustrate an ice discharging process of the refrigerator according to the embodiment of the present invention.

First, a non-shaved ice cubes discharging process will be described by referring to FIG. 3*a*.

When a user presses the ice lever 65 toward an ice container, after the user selects the discharge of ice cubes to the dispenser part 61 through the operating panel 63, a controller (not shown) drives the lever operating part 55 and the ice carrying part 27 on the basis of the operation of the ice lever 65.

The operating lever 51 is separated from the supporting blade 45 by the lever operating part 55 and moves to the opening position so that ice is not shaved.

As the ice carrying part 27 operates, the ice stored in the ice container 23 is carried toward the opening 25 by rotation of the rotating body 29, and then is moved into the ice carrying path 39 of the cover 35. Then, a predetermined amount of ice, corresponding to the rotating speed of the rotating blades 41, is moved in between the adjacent rotating blades 41.

The ice moved into the ice carrying path 29 is carried to an area of the outlet 37 along the back of the rotating blades 41.

Meanwhile, as the operating lever 51 is separated from the supporting blade 45, the ice carried to the outlet 37 by the rotating blades 41 is discharged between the supporting blade 45 and the operating lever 51 to the outlet 37 in the shape of ice cubes, and then is discharged to the dispenser part 61 through the ice duct 71. As the maximum amount of ice discharged to the outlet 37 is set by the size of the space between the rotating blades 41, the ice is able to be supplied in a consistent amount without overflow, thereby improving convenience for a user.

Figure 3B:
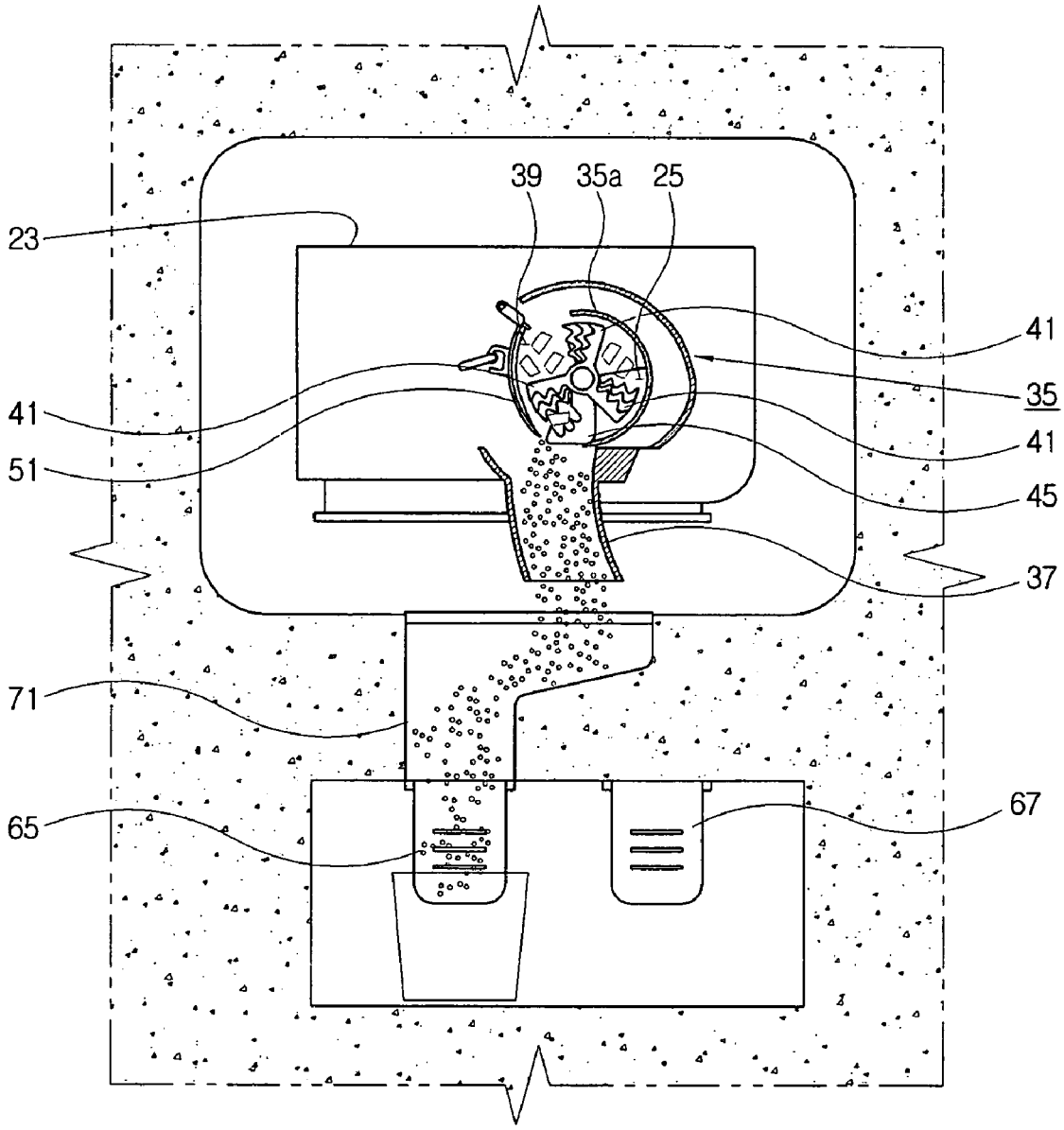
Figure 4A:
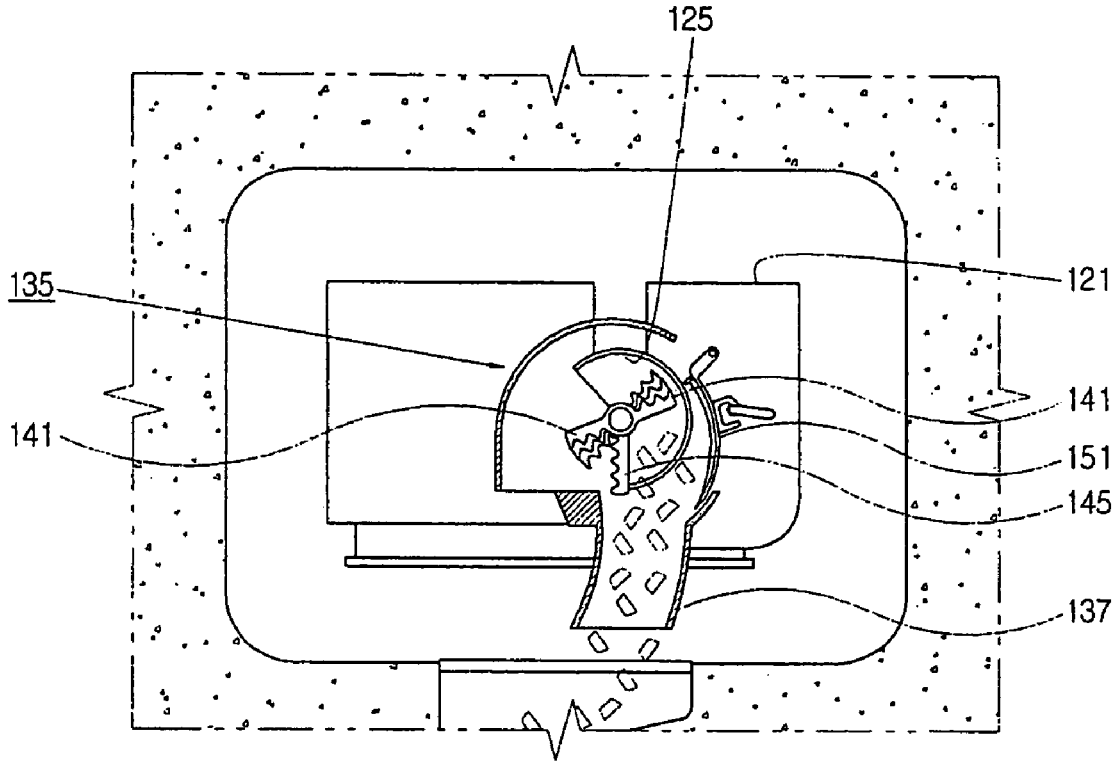
FIG. 4A (PRIOR ART)
FIGS. 4*a* and 4*b* illustrate an ice discharging process of a conventional refrigerator.
Figure 4B:
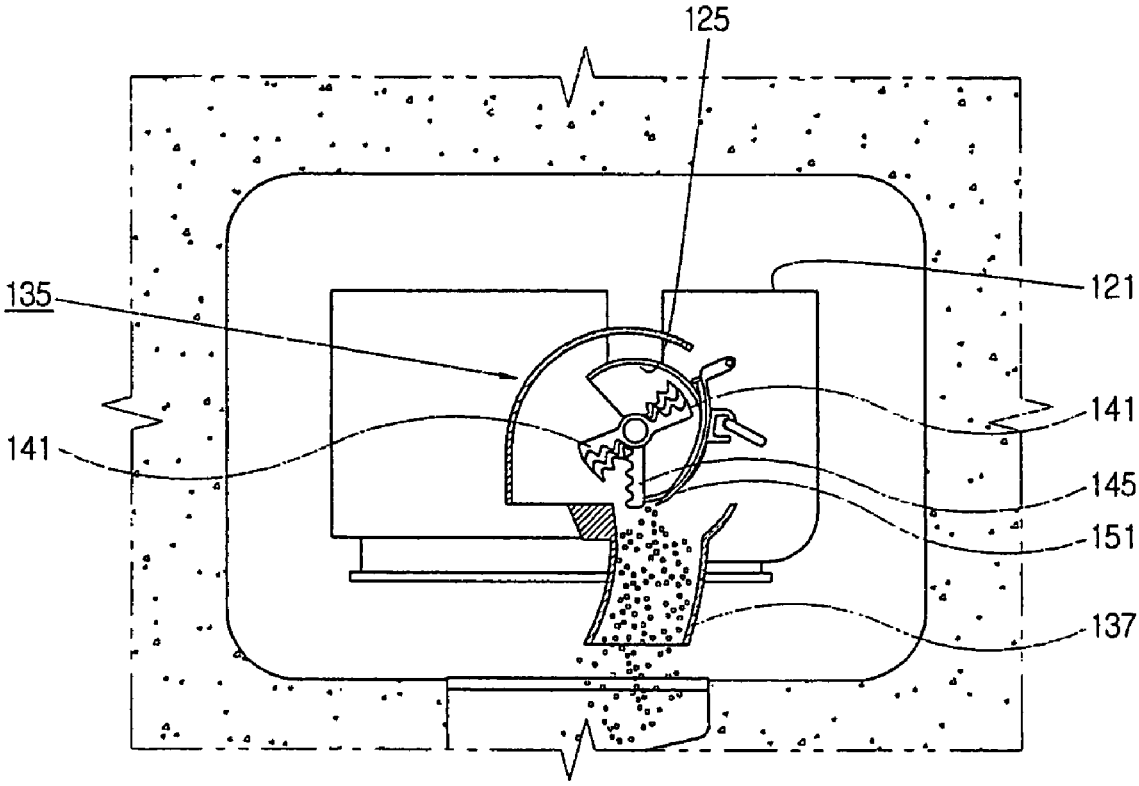
FIG. 4B (PRIOR ART)

Next, a discharging process for crushed ice in the refrigerator according to the embodiment of the present invention will be described by referring to FIG. 3*b*.

When a user presses the ice lever 65 toward a container to hold ice, after the user selects the discharge of crushed ice through the operating panel 63, the controller (not shown) drives the lever operating part 55 and the ice carrying part 27 on the basis of an operation of the ice lever 65.

The operating lever 51 approaches the supporting blade 45 by the driving of the lever operating part 55 and moves to a crushing position in order to crush ice.

As the ice carrying part 27 operates, the ice stored in the ice container 23 is carried toward the opening 25 by rotation of the rotating body 29, and then is moved into the ice carrying path 39. Thus, a predetermined amount of ice, corresponding to the rotating speed of the rotating blades 41, is moved in between the adjacent rotating blades 41.

The ice moved into the ice carrying path 39 is carried to the outlet 37 along the back of the rotating blades 41.

Meanwhile, as the operating lever 51 approaches the supporting blade 45 such that an end part of the supporting blade 45 contacts the operating lever 51, the ice carried to the outlet 37 by the rotating blades 41 is crushed by a reciprocal operation of the rotating blades 41 and the supporting blade 45, and then is discharged in the shape of crushed ice through the outlet 37 to be discharged to the dispenser part 61 through the ice duct 71. As the amount of crushed ice fed to the rotating blades 41 is more consistently delivered, the load of the respective blades 41 and 45 is reduced when the ice is crushed, thereby preventing the breakdown of parts caused by overload of the blades and sputtering of the crushed ice.

It is described above that the three rotating blades are arranged making an isometric angle, but more than four rotating blades, for example, may be arranged making an isometric angle.

As described above, the refrigerator according to the embodiment of the present invention can discharge ice in regular amounts regardless of its crushing condition by improving the discharging configuration to carry the ice to the outlet by the rotating blades and by placing the outlet to deviate from the ice discharging axis of the opening, thereby improving convenience for a user and preventing the breakdown of parts due to overloading by reducing the load on the blades when crushing ice.

Although an embodiment of the present invention has been shown and described, it will be appreciated by those skilled in the art that changes may be made in this embodiment without departing from the principles and spirit of the invention, the scope of which is defined in the appended claims and their equivalents.

What is claimed is:

1. A refrigerator, comprising:

an ice making device making ice;

an ice container storing the ice made in the ice making device comprising:

an opening through which the ice is discharged, and a carrying shaft carrying the ice to the opening;

an outlet, into which the ice carried to the opening is supplied, discharging the ice to an outside of the refrigerator;

three rotating blades coupled with the carrying shaft and carrying the ice discharged from the opening to the outlet;

a supporting blade provided adjacent to the outlet and reciprocally moving with respect to the rotating blades; and an operating lever arranged adjacent to the opening, wherein the outlet is arranged to deviate from an ice discharging axis of the opening, and the operating lever reciprocally moves between a separation position in which the operating lever is separated from a radial end of the supporting blade by a gap and an approach position in which the operating lever approaches the radial end of the supporting blade and reduces the gap, the gap formed between the operating lever and the supporting blade in the separation position accommodating unshaved ice, the reduced gap formed between the operating lever and the supporting blade in the approach position forcing the ice from the gap into a path to be shaved by a reciprocal operation of the rotating blades and the supporting blade, and wherein the three rotating blades include at least three sets of rotating blades arranged in a substantially isometric angle with respect to one another and maintaining the substantially isometric angle during rotation of the carrying shaft.

2. The refrigerator according to claim 1, further comprising a cover in which an ice carrying path is formed to carry the ice discharged from the opening to the outlet.

3. The refrigerator according to claim 1, wherein at least one of three rotating blades include at least three branches arranged in a substantially isometric angle with respect to one another and extended in a radial direction from the carrying shaft.

4. A refrigerator, comprising:

an ice container having an opening to discharge ice;

a cover having an outlet discharging the ice, into which the ice discharged from the opening is supplied, to an outside of the refrigerator and an ice carrying path formed to carry the ice discharged from the opening to the outlet;

a plurality of rotating blades to carry the ice discharged from the opening to the outlet through the ice carrying path;

a supporting blade arranged adjacent to the outlet and supported to shave the ice; and an operating lever reciprocally moving between a first position in which ice cubes are discharged and a second position in which shaved ice is discharged, wherein the operating lever reciprocally moves between the first position in which the operating lever is separated from a radial end of the supporting blade by a gap and the second position in which the operating lever approaches the radial end of the supporting blade and reduces the gap, the gap formed between the operating lever and the supporting blade in the first position accommodating unshaved ice, the reduced gap formed between the operating lever and the supporting blade in the second position forcing the ice from the gap into a path to be shaved by a reciprocal operation of the rotating blades and the supporting blade, and wherein the plurality of rotating blades include at least three sets of rotating blades arranged in a substantially isometric angle with respect to one another and maintaining the substantially isometric angle during rotation of the carrying shaft.

5. The refrigerator according to claim 4, wherein the rotating blades include at least four blades.

6. The refrigerator according to claim 5, wherein the operating lever is rotatably connected with the ice storage part.

7. The refrigerator according to claim 4, further comprising an ice carrying part carrying the ice to the opening and having a carrying shaft, wherein the outlet is arranged opposite the opening of the ice container with respect to the carrying shaft so that the ice discharged from the opening can be carried by the rotating blades and be discharged through the outlet to the outside.

8. A refrigerator, comprising:

an ice container having an opening to discharge ice and a carrying shaft to carry the ice to the opening;

a cover having an outlet discharging the ice, into which the ice discharged from the opening is supplied, to an outside of the refrigerator and an ice carrying path formed to carry the ice discharged from the opening to the outlet;

a plurality of rotating blades coupled to the carrying shaft;

an operating lever arranged adjacent to the opening; and a supporting blade placed between the outlet and the opening and shaving the ice along with the rotating blades, wherein the outlet is arranged to deviate from an ice discharging axis of the opening, and the shaved ice and the ice cubes are discharged in one direction with respect to the supporting blade, the operating lever reciprocally moves between a separation position in which the operating lever is separated from a radial end of the supporting blade by a gap and an approach position in which the operating lever approaches the radial end of the supporting blade and reduces the gap, the gap formed between the operating lever and the supporting blade in the separation position accommodating unshaved ice, the reduced gap formed between the operating lever and the supporting blade in the approach position forcing the ice from the gap into a path to be shaved by a reciprocal operation of the rotating blades and the supporting blade, and the plurality of rotating blades include at least three sets of rotating blades arranged in a substantially isometric angle with respect to one another and maintaining the substantially isometric angle during rotation of the carrying shaft.

9. The refrigerator according to claim 8, wherein the outlet is arranged opposite the opening with respect to the carrying shaft.

10. A ice supplying device, comprising:

an ice container storing ice;

an outlet, into which the ice is supplied, receiving ice from the ice container;

an ice carrying part carrying the ice from an internal portion of the ice container to the outlet, the ice carrying part moving the ice in a forward direction to an opening of the ice container and into the outlet;

a plurality of rotating blades coupled with the carrying shaft and carrying the ice discharged from the opening to the outlet;

a supporting blade provided adjacent to the outlet and reciprocally moving with respect to the rotating blades; and an operating lever arranged adjacent to the opening, wherein the operating lever reciprocally moves between a separation position in which the operating lever is separated from a radial end of the supporting blade by a gap and an approach position in which the operating lever approaches the radial end of the supporting blade and reduces the gap, the gap formed between the operating lever and the supporting blade in the separation position accommodating unshaved ice, the reduced gap formed between the operating lever and the supporting blade in the approach position forcing the ice from the gap into a path to be shaved by a reciprocal operation of the rotating blades and the supporting blade, and wherein the plurality of rotating blades include at least three sets of rotating blades arranged in a substantially isometric angle with respect to one another and maintaining the substantially isometric angle during rotation of the carrying shaft.

11. The ice supplying device according to claim 10, wherein the ice carrying part includes a rotating body carrying the ice toward the opening and a carrying shaft rotating the rotating body.

12. The ice supplying device according to claim 11, wherein the outlet of the ice supplying device is arranged opposite the opening of the ice container with respect to the carrying shaft.

13. A refrigerator, comprising:

a refrigerating chamber cooling material in the refrigerating chamber above a freezing temperature;

a freezing chamber cooling material in the freezing chamber at or below the freezing temperature;

an ice container disposed within the freezing chamber and storing ice made in the freezing chamber;

an outlet, into which the ice is supplied, receiving the ice from the ice container;

an ice carrying part carrying the ice from an internal portion of the ice container to the outlet, the ice carrying part moving the ice in a forward direction to an opening of the ice container and into the outlet; and a plurality of rotating blades carrying the ice discharged from the opening to the outlet;

a supporting blade provided adjacent to the outlet and reciprocally moving with respect to the rotating blades; and an operating lever arranged adjacent to the opening, wherein the operating lever reciprocally moves between a separation position in which the operating lever is separated from a radial end of the supporting blade by a gap and an approach position in which the operating lever approaches the radial end of the supporting blade and reduces the gap, the gap formed between the operating lever and the supporting blade in the separation position accommodating unshaved ice, the reduced gap formed between the operating lever and the supporting blade in the approach position forcing the ice from the gap into a path to be shaved by a reciprocal operation of the rotating blades and the supporting blade, and wherein the plurality of rotating blades include at least three sets of rotating blades arranged in a substantially isometric angle with respect to one another and maintaining the substantially isometric angle during rotation of the carrying shaft.

* * * * *